United States Patent [19]

Weber

[11] Patent Number: 4,796,689

[45] Date of Patent: Jan. 10, 1989

[54] MOLD FOR ELECTROMAGNETIC CONTINUOUS CASTING

[75] Inventor: Jean-Claude Weber, Sierre, Switzerland

[73] Assignee: Swiss Aluminium Ltd., Chippis, Switzerland

[21] Appl. No.: 167,536

[22] Filed: Mar. 14, 1988

[30] Foreign Application Priority Data

Mar. 23, 1987 [CH] Switzerland ..... 1095/87

[51] Int. Cl.[4] ..... B22D 27/02

[52] U.S. Cl. ..... 164/503; 164/467

[58] Field of Search ..... 164/503, 467

[56] References Cited

U.S. PATENT DOCUMENTS 4,216,817 8/1980 Meier ..... 164/467

4,512,386 4/1985 Haller ..... 164/503

*Primary Examiner*—Kuang Y. Lin

*Attorney, Agent, or Firm*—Bachman & LaPointe

[57] ABSTRACT

An electromagnetic mold for vertical continuous casting of rolling slabs, featuring an inductor and an electromagnetic screen partly covering the induction is such that the vertical distance between the lower edge of the inductor and the lower edge of the screen is greater at the narrow sides of the mold than at the broad sides of the mold. As a result of this arrangement it is possible to prevent metal running out of the ingot head at the narrow sides during the start-up phase. The foregoing is achieved at the expense of an insignificant amount of melt circulation occurring in the molten head of the ingot.

8 Claims, 1 Drawing Sheet

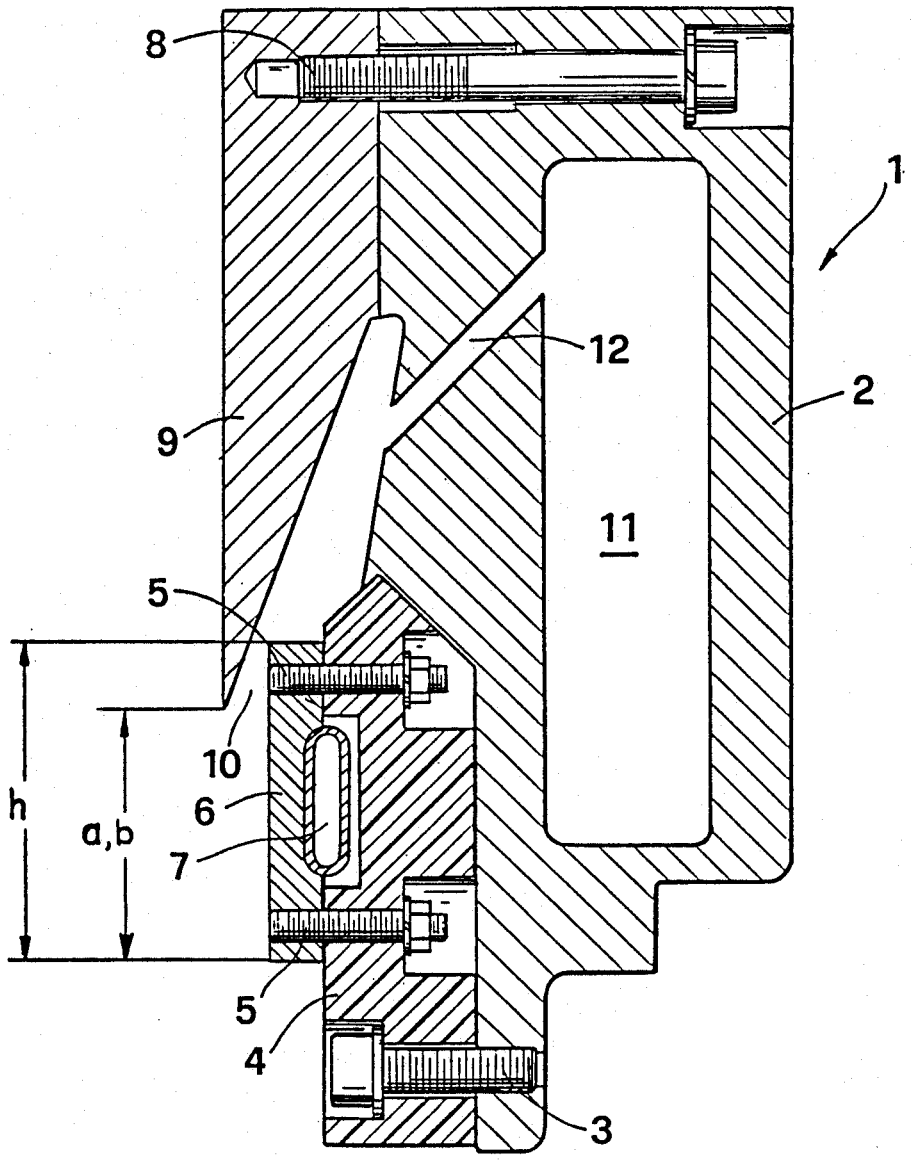
8
1
12
2
9
11
5
10
h
6
a,b
7
5
4
3

MOLD FOR ELECTROMAGNETIC CONTINUOUS CASTING

BACKGROUND OF THE INVENTION

The invention relates to a mold for vertical electromagnetic continuous casting of rolling slabs, said mold having an inductor and partly covering this an electromagnetic screen such that the screen with respect to the inductor is arranged at the broad sides of the mold in a way that the electromagnetic turbulence created in the molten head of the ingot being cast is insignificant.

By the term rolling slabs is to be understood continuously cast ingots having board sides that represent the rolling surface and narrow sides that, together with the former, form an essentially rectangular cross-section.

In the process of electromagnetic continuous casting the heat in the ingot strand emerging from the mold is extracted by jetting the ingot surface with coolant immediately below the mold. During the start-up phase the coolant only strikes the dummy base. The resultant indirect extraction of heat leads to slow solidification of the molten metal and hence to a flat ingot foot. With progressive lowering of the dummy base the coolant strikes the surface of the ingot directly, which produces a sudden increase in the rate of heat extraction from the ingot. The thermal stresses resulting from this thermal shock are greater than the yield stress of the ingot and lead to permanent deformation in the form of a convex curvature of the ingot foot.

In order to keep the ingot foot as flat as possible, one can for example reduce the cooling intensity at least during the start-up phase. In one known process use is made of a coolant that has gas dissolved in it, this causing an insulating film to form on the ingot surface and with that a reduction in heat extraction.

A basic advantage of electromagnetic casting as compared with conventional continuous casting is the uniform ingot surface that forms, free of cold shuts, bleeding, surface segregation and other near surface defects, thus in most cases making it unnecessary to scalp the ingot surface.

The electromagnetic field created by the inductor induces circulation of the melt in the molten ingot head. This electromagnetic turbulence can, among other things, lead to the oxide skin being torn away and consequently to a worsening of the solidification conditions and the melt quality in the region of the solidifying ingot surface. This expresses itself for example as an accumulation of oxide inclusions, in longitudinal folds and as surface defects that do not appear until the material has been processed further e.g. slivers, looper lines and the like. Particularly sensitive are of course alloys with a strong tendency to oxidize such as aluminum magnesium alloys having a magnesium content of 4% or more. Problems can also arise during the casting of special high grade materials that may require the ingot to be scalped; as a result it may not be possible to exploit to the full the general advantages of electromagnetic casting.

A known method of minimizing the electromagnetic turbulence is to increase the covering of the inductor by means of the electromagnetic screen. On increasing the covering, however, the electromagnetic force directed at the center of the ingot is reduced. As a result problems can arise during start-up in that, due to the reduced electromagnetic force and the curvature of the ingot foot, molten metal can run out at the narrow side of the ingot, making it neseccary to halt the casting process.

In view of the above it is an object of the present invention to develop an electromagnetic mold of the kind mentioned at the start for continuous casting such that metal run-out from the ingot during the start-up phase can be prevented, this at the expense of an insignificant amount of melt turbulence in the molten head of the ingot being cast.

SUMMARY OF THE INVENTION

The foregoing object is achieved by way of the present invention wherein the screen at the narrow side of the mold is arranged or designed in such a way that the electromagnetic force acting on the molten ingot head is greater at the narrow sides of the mold than at its broad sides.

In light of the arrangement of the present invention as set forth above, the electromagnetic force directed at the narrow sides of the mold are increased so that a certain degree of bulging of the ingot foot can be tolerated without there being any danger of melt run-out occurring at the narrow sides. The casting process is therefore safer during the start-up phase. The circulation of the melt in the molten lead of the ingot is as a result increased only slightly. In particular, the design of the mold according to the invention makes it possible to cast large format rolling slabs of aluminum alloys containing 4% and more of magnesium.

In one version according to the invention the vertical distance between the lower edge of the inductor and the lower edge of the screen at the narrow sides of the mold is greater than that at the broad sides.

In a preferred version the lower edges of the screen at the broad and narrow sides of the mold lie at the same level; the inductor in that case lies higher at the broad sides of the mold than at the narrow sides. The simple measure of displacing the position of the inductor offers the advantage that the line of contact of the coolant with the ingot, normally determined by the inner surface of the electromagnetic screen, remains unchanged.

In another version the inductor is situated at the same level at the narrow and broad sides of the mold; the lower edges of the screen in this case are higher at the narrow sides than at the broad sides of the mold.

The difference in vertical distance between the lower edge of the screen and the lower edge of the inductor at the broad side and the same vertical distance at the narrow side of the mold is preferably at most 70%, preferably 10–30%, of the vertical dimension of the inductor.

In a further version according to the invention the screen features at the narrow sides of the mold a different geometrical cross-section or a different electrical conductivity than at the broad sides of the mold.

The arrangement of inductor and electromagnetic screen according to the invention refers of course not only to molds of fixed ingot cross-section that can be cast with it; on the contrary, it is particularly suitable also for molds that can be adjusted to cast ingots of different cross-section, e.g. for a mold with stationary side walls and displaceable end walls, as revealed in the European patent publication EP-A-0 109 357.

BRIEF DESCRIPTIONS OF THE DRAWINGS

Further advantages, features and details of the invention are revealed in the following description of a preferred exemplified embodiment; this with the aid of the single schematic drawing of a mold side-wall shown in cross-section.

DETAILED DESCRIPTION

A mold 1 features a cooling chamber 2 onto which a support 4 of electrically insulating material is mounted by means of bolts 3. Mounted on this support 4 by means of bolts 5 is a loop-shaped inductor 6 featuring at its back a tubular-shaped cooling channel 7 to accommodate a cooling medium. Bolt 8 secures to the cooling chamber 2 a downward tapering electromagnetic screen 9 of electrically conductive, non-ferromagnetic material. The screen 9 and inductor 6 create a gap 10 through which the coolant medium passes on its way from a coolant chamber 11 then channel 12 to the surface of an ingot being cast but not shown here.

For a vertical dimension h of the inductor 6 corresponding to 40 mm, the vertical distance between the lower edge of the screen and the lower edge of the inductor is for example at the broad faces of the mold a=25 mm and at the narrow face b=35 mm. As a result there is a difference of 10 mm in the vertical distances a,b, representing 25% of the vertical dimension h of the inductor.

It is to be understood that the invention is not limited to the illustrations described and shown herein, which ae deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A mold for the electromagnetic continuous casting of rolling slabs comprising a substantially rectangular support frame having a pair of broad sides and a pair of narrow sides, an inductor associated with said substantially rectangular support frame for applying a magnetic field to define a mold cavity, and a screen associated with said substantially rectangular support frame and said inductor for controlling the electromagnetic force applied by said inductor wherein the screen at the narrow sides of the substantially rectangular support frame is arranged with respect to the inductor such that the electromagnetic force acting on the mold cavity is greater at the narrow sides of the mold than at the broad sides of the mold.

2. A mold according to claim 1 wherein the inductor and the screen have a lower edge and the vertical distance between the lower edge of the inductor and the lower edge of the screen is greater at the narrow sides of the mold than at the broad sides of the mold.

3. A mold according to claim 2 wherein the lower edge of the screen at the broad and narrow sides of the mold lies at the same height and the lower edge of the inductor on the broad sides of the mold is situated at a higher level than at the narrow sides of the mold.

4. A mold according to claim 2 wherein the lower edge of the inductor is arranged at the same height on the narrow and broad sides of the mold and the lower edge of the screen lies at a higher level on the narrow sides of the mold than at the broad sides of the mold.

5. A mold according to claim 2 wherein the difference in the vertical distance (a) between the lower edge of the screen and the lower edge of the inductor at the broad sides of the mold and the vertical distance (b) between the lower edge of the screen and the lower edge of the inductor at the narrow sides of the mold is at most 70% of the vertical dimension (h) of the inductor coil.

6. A mold according to claim 2 wherein the difference in the vertical distance (a) between the lower edge of the screen and the lower edge of the inductor at the broad sides of the mold and the vertical distance (b) between the lower edge of the screen and the lower edge of the inductor at the narrow sides of the mold is between 10 to 30% of the vertical dimension (h) of the inductor coil.

7. A mold according to claim 2 wherein the screen has in cross-section a different geometry at the narrow sides of the mold from that at the broad sides of the mold.

8. A mold according to claim 2 wherein the screen exhibits a different electrical conductivity at the narrow sides of the mold from that at the broad sides of the mold.

* * * * *